US007891755B2

(12) United States Patent
Mantell

(10) Patent No.: US 7,891,755 B2
(45) Date of Patent: Feb. 22, 2011

(54) SYSTEM AND METHOD FOR IMAGING INK SUPPLIES IN A PRINTER

(75) Inventor: David Allen Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 542 days.

(21) Appl. No.: 12/002,749

(22) Filed: Dec. 18, 2007

(65) Prior Publication Data

US 2009/0153603 A1 Jun. 18, 2009

(51) Int. Cl.
*B41J 29/393* (2006.01)
*B41J 2/175* (2006.01)

(52) U.S. Cl. ..... 347/19; 347/88

(58) Field of Classification Search ..... 347/19, 347/88; 382/209, 218
See application file for complete search history.

(56) References Cited

U.S. PATENT DOCUMENTS 4,611,899 A 9/1986 Kasamura et al.
4,870,430 A 9/1989 Daggett et al.
5,442,387 A 8/1995 Loofbourow et al.
5,510,821 A 4/1996 Jones et al.
5,734,402 A 3/1998 Rousseau et al.
5,861,903 A 1/1999 Crawford et al.
6,543,867 B1 4/2003 Jones
2007/0296781 A1 * 12/2007 Jones et al. ..... 347/88
2007/0296783 A1 * 12/2007 Jones ..... 347/88

* cited by examiner

*Primary Examiner*—Julian D Huffman
(74) *Attorney, Agent, or Firm*—Maginot, Moore & Beck LLP

(57) ABSTRACT

A method identifies ink supplied to a printer. The method includes generating an image of an ink supply installed in a printer, comparing the image of the ink supply to a stored reference image of at least one ink supply, and activating an indicator in response to the generated image corresponding to the stored reference image.

12 Claims, 3 Drawing Sheets

SYSTEM AND METHOD FOR IMAGING INK SUPPLIES IN A PRINTER

TECHNICAL FIELD

The device and method described herein generally relate to printers that generate hard copies of documents using marking materials, such as ink or toner. More specifically, the device and method relate to printers that verify proper installation of marking material in the printer.

BACKGROUND

"Printers" refer to reproduction devices in general, such as printers, facsimile machines, copiers, and related multi-function products. These printers produce images with marking materials on media. A printed image is comprised of pixels, which are small masses of marking material. Common marking materials include dry ink, toner, with and without metal particles, wet inks of many forms, such as aqueous ink, and solid inks, which are melted to generate liquid ink. The marking materials may be directly applied to media, either in sheet or web form, or to an intermediate imaging member before being transferred to media. The process of producing an image and fixing it to some form of media may require several steps and many components to perform the several steps.

The marking materials have many properties, each one of which may affect printer performance and copy quality. Using the proper marking materials helps ensure the reliable operation of the printer and satisfactory copy quality. Selection of marking materials in color printers is particularly important. In color printers, pixels of separate colors of ink are typically applied to the media to form the colored image. The amount of ink in a pixel and the distance between pixels affect the color shade and intensity of an image. The marking material for each color is placed in a separate ink supply and the ink from each supply is delivered to a corresponding print head that ejects ink for that particular color only. Some color printers use the primary colors of red, blue, and green, while other printers use colors of magenta, cyan, yellow, and black.

Previously known printers have installation sites or ink loaders into which ink may be installed. Installation sites may refer to, for example, fixtures to which an ink cartridge containing aqueous ink may be coupled or fixtures to which a toner cartridge containing dry ink may be coupled. An installation site may be provided for each color of ink used by the printer. An interface is typically exposed by removing an adhesive tape or the like before an ink cartridge is installed. The interface enables a controller in the printer to provide electrical control signals to the cartridge for selectively obtaining ink from the cartridge for use within the printer. Ink loaders in solid ink printers typically include multiple feed channels, one for each color, into which units of solid ink are loaded. The loader also includes some type of mover for directing the solid ink units through a feed channel to a melting device. The melting device heats the solid ink units and produces liquid ink. The liquid ink is provided to print heads for ejection onto an imaging member in pixel patterns.

To reduce the likelihood that an incorrect ink supply is placed in an ink installation site or an ink loader, the installation site fixtures or channel insertion ports are configured to identify ink supplies not having the necessary properties for use in the printer. For example, an insertion port for a feed channel may be covered by a plate having a cutout with a particular predefined shape. The predefined shape corresponds to a shape for a particular color of solid ink units, for example. The plate, therefore, helps identify solid ink units that are a color other than the color intended for the feed channel. For colors that are similar to one another, such as cyan and black, this feature helps prevent the melted ink supply from becoming contaminated with ink of the wrong color.

While fixture and loader configurations help identify ink cartridges or solid ink units for particular models of printers, these features may not be effective for ink intended for other models. For example, the plate described above with reference to a feed channel for one particular printer may have an opening that is substantially larger than a solid ink unit intended for use in another printer. Consequently, the smaller solid ink unit does not engage the perimeter of the opening and can be accepted within the insertion port of the loader. More robust methods for identifying ink cartridges, solid ink units, toner cartridges, and the like are desirable.

SUMMARY

A method identifies ink supplied to a printer without requiring physical contact with the ink supply being loaded. The method includes obtaining an image of an ink supply installed in a printer, comparing the image of the ink supply to a stored image of at least one ink supply, and activating an indicator in response to the generated image corresponding to the stored image.

A system for monitoring ink provided to a printer includes an imaging device located within a printer that obtains an image of an ink supply installed in the printer and an image comparator that is coupled to the imaging device. The image comparator is configured to compare the ink supply image of the ink supply received from the imaging device to an image of an ink supply stored in the printer and to generate a signal indicating whether the image of the received ink supply corresponds to the stored image.

A printer includes a print head, an ink supply site, an imaging device, and an image comparator. The print head ejects ink to form an image. The imaging device is located proximate the ink supply site to generate an image of an ink supply located at the ink supply site. The image is provided to the image comparator, which is configured to compare the ink supply image to an image of an ink supply stored in the printer. The comparator generates a signal that indicates whether the ink supply image corresponds to the stored ink supply image.

BRIEF DESCRIPTION OF THE DRAWINGS

Features of the present invention will become apparent to those skilled in the art from the following description with reference to the drawings, in which.

DETAILED DESCRIPTION

The term "printer" refers, for example, to reproduction devices in general, such as printers, facsimile machines, copiers, and related multi-function products. While the specification focuses on a system that images solid ink sticks in solid ink printers, the system may be used in any printer that uses marking materials to form an image. The term ink stick refers to any form of solid ink such as blocks, pastilles, or other solid pieces that are delivered to a melting device for conversion to liquid ink.

Figure 1:
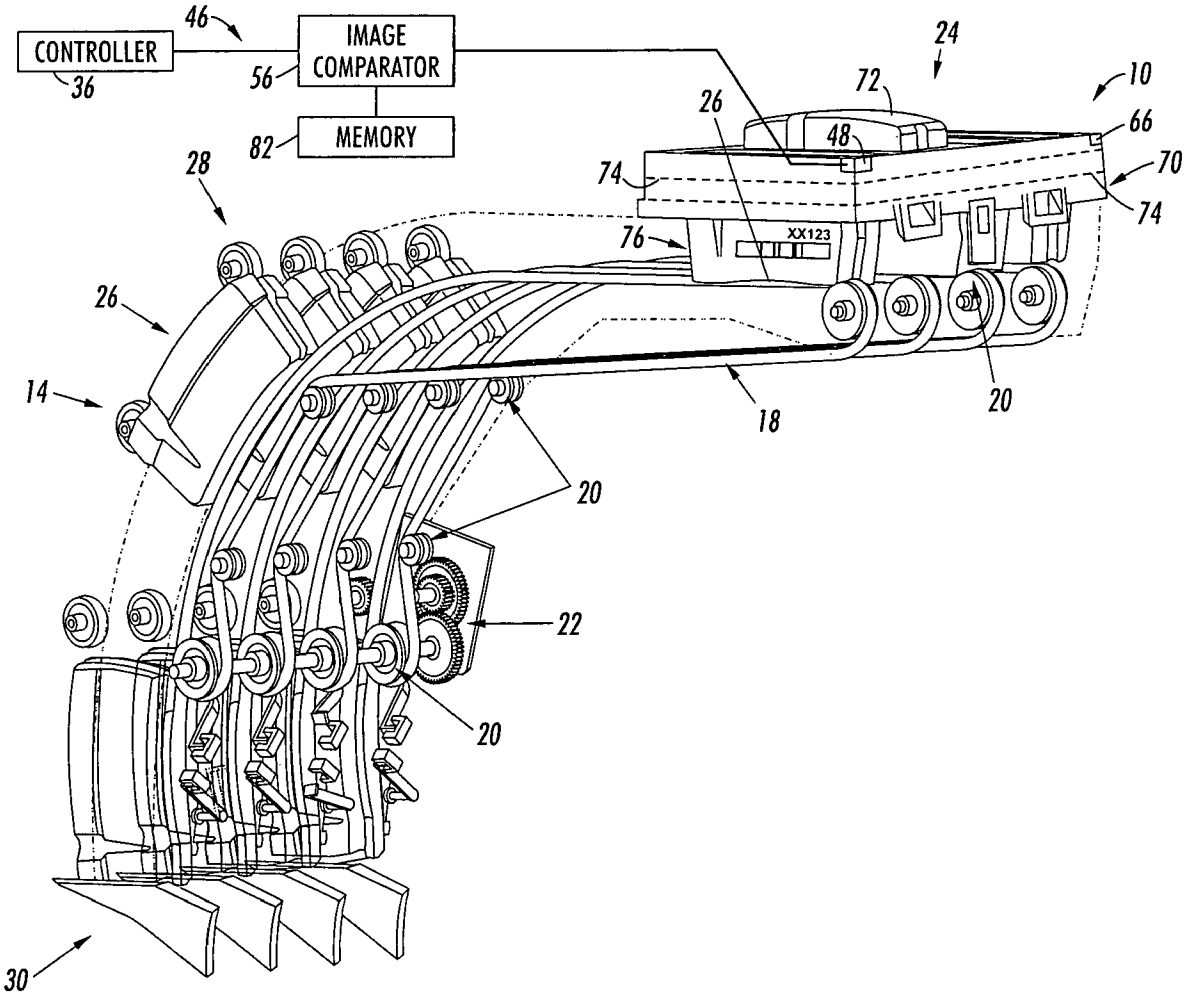
FIG. 1 is a perspective view of an ink loader in a solid ink printer.

An ink loader 10 that includes a mechanized drive and a gravity fed section is depicted in FIG. 1. As shown in the figure, a curved feed channel 14 includes an endless belt 18 mounted around pulleys 20, at least some of which are driven by a motor and gear train 22 or the like. An ink stick 26 placed in a port 24 engages the belt 18 and is carried along the feed channel 14 in response to the pulleys 20 being driven. After transitioning through the curve 28, the ink stick begins a fall towards a melting device 30. As shown in FIG. 1, a stack of ink sticks may develop in the gravity fed portion of the feed channel 14. The weight of these sticks help urge the bottom-most stick against the melting device for more efficient melting.

According to an embodiment of the present disclosure and referring to FIG. 1, a system 46 may be coupled to the ink loader 10 to identify ink supplies installed in the loader port 24 that obtains an image of an ink supply, such as a stick 26. The system 46 includes an image comparator 56, which is coupled to an imaging device 48. The image comparator 56 is configured to compare the ink supply image received from the imaging device 48 to an image of an ink supply stored in memory 82. The memory 82 may be any device for storing information in, for example, digital form. Typically, the memory is located within the printer housing, although it may be located remotely from the printer and accessed through a computer communication connection.

The imaging device 48 may be any device capable of obtaining an image of an ink supply to be utilized in the system 46. For example, the imaging device 48 may be a digital device, such as a digital camera. If the imaging device 48 is a digital camera, the device 48 may generate a solitary frame of digital imaging data of the ink supply installed in the loader 10. The digital camera may be a video camera that generates a series of frames of data over time. The imaging device 48 may be in the form of a single camera or may include in addition to first digital camera 48, a second digital camera 66 positioned in a spaced apart relationship from the first digital camera 48. The use of the second digital camera 66 may serve to provide separate images of the ink supply such that a three dimensional representation of the ink supply may be generated through software. Alternatively or additionally, each feed channel may include an imaging device in the port 24 to generate an image or images of ink supplies loaded into the feed channel. The imaging device may be, for example, a camera, such as, a cellular telephone camera or the like.

The imaging device 48 of the system 46 is typically positioned at a location such that it may be directed toward the site or sites where ink supplies are installed in the loader 10 so that the portion of interest on the ink supply is within the field of vision of the imaging device 48 to enable generation of images of the ink supplies as they enter the loader. Positioning the image device 48 in this manner enables an ink supply that has been identified as being incompatible with a feed channel to be removed from the port 24. For example, as shown in FIG. 1, the first digital camera 48 may be positioned along a first internal wall of the port 24 of the ink loader 10 and pointed at the ink stick 26. The second digital camera 66, mounted onto a second internal wall of port 24 of loader 10, is able to obtain an image of the ink stick from another perspective.

While the digital camera 48 may be fixedly positioned in a direction toward an ink supply, the digital camera 48 may alternatively include an orientation system 70 to alter the orientation of the digital camera 48 in a plurality of directions. For example, the orientation system 70 may include a pivoting servomechanism 72 that can be selectively controlled to rotate the first digital camera 48 in multiple directions about its pivot point. The orientation system 70 may also include one or more translating mechanisms 74 (shown in phantom) for moving the digital camera 48 along dimensions of the loader 10. The second digital camera 66 may also include similar pivoting or translating mechanisms (not shown) for movement of the second camera 66.

Using a single camera or multiple cameras, three dimensional images of the ink supply may be generated. For example, a single camera coupled to a positioning system may be moved to different positions and the images from the two or more different positions may be used to generate a three dimensional image of the supply. In a similar manner, different images from two or more cameras located at different fixed positions may be used to generate a three dimensional image of the ink supply. Alternatively, a single camera obtaining images of the supply under different lighting conditions can be used to generate a three dimensional image of the ink supply. Also, images obtained by a monochrome camera under differently colored lights may be used to generate a color image of the ink supply.

While the camera may be moved to obtain an image of an ink supply, the ink supply may also be moved for this purpose. For example, a motorized transport mechanism may be located at an insertion port or site in which an ink supply is placed or installed. The transport mechanism may then be operated by a controller to move the ink supply to a particular position for image collection. The controller may also respond to an image processor that receives the images from the camera(s) and processes the images. The image processor may be configured to generate a signal that is sent to the controller to indicate the ink supply is to be moved to another position for further imaging.

The camera 48 may obtain one or more frames of data of an ink supply at any of various camera locations and orientations available with the orientation system 70. The image data from the camera(s) may be used by the image comparator 56 to compare one or more reference images stored in the memory 82. The memory 82 may be updated with additional or replacement reference images with portable data collection devices during service visits or through computer network communications with a central site on a periodic or occasional basis. In this manner, the printer may be updated to recognize new ink supply types or other ink supply modifications.

The image comparator 56 may also be configured to compare indicia 76, as shown in FIG. 1, on ink supply, such as ink stick 26, to reference indicia stored in the memory 82. Of course, these reference indicia may be updated in one or more ways similar to those discussed above for the reference images. The indicia 76 may be in the form of machine readable indicia, such as a bar code, for example. The indicia may be printed, implanted, or formed directly on an ink supply or the indicia may be printed on a label or other surface applied to the ink supply. After receiving the images of the ink supply from the camera(s), the image comparator 56 may also compare characters in the form of numerals and/or letters on the ink supply 52 to at least one numeral and/or at least one letter stored in the memory 82. To help ensure that the character and/or indicia comparisons are more robust, the comparator or an image processor may manipulate the images in a known manner to identify the detected differences as being related to image conditions rather than character or indicia differences.

The comparator may also compare a shape of the ink supply in an image to a reference ink supply shape stored in a memory of the printer.

Figure 2:
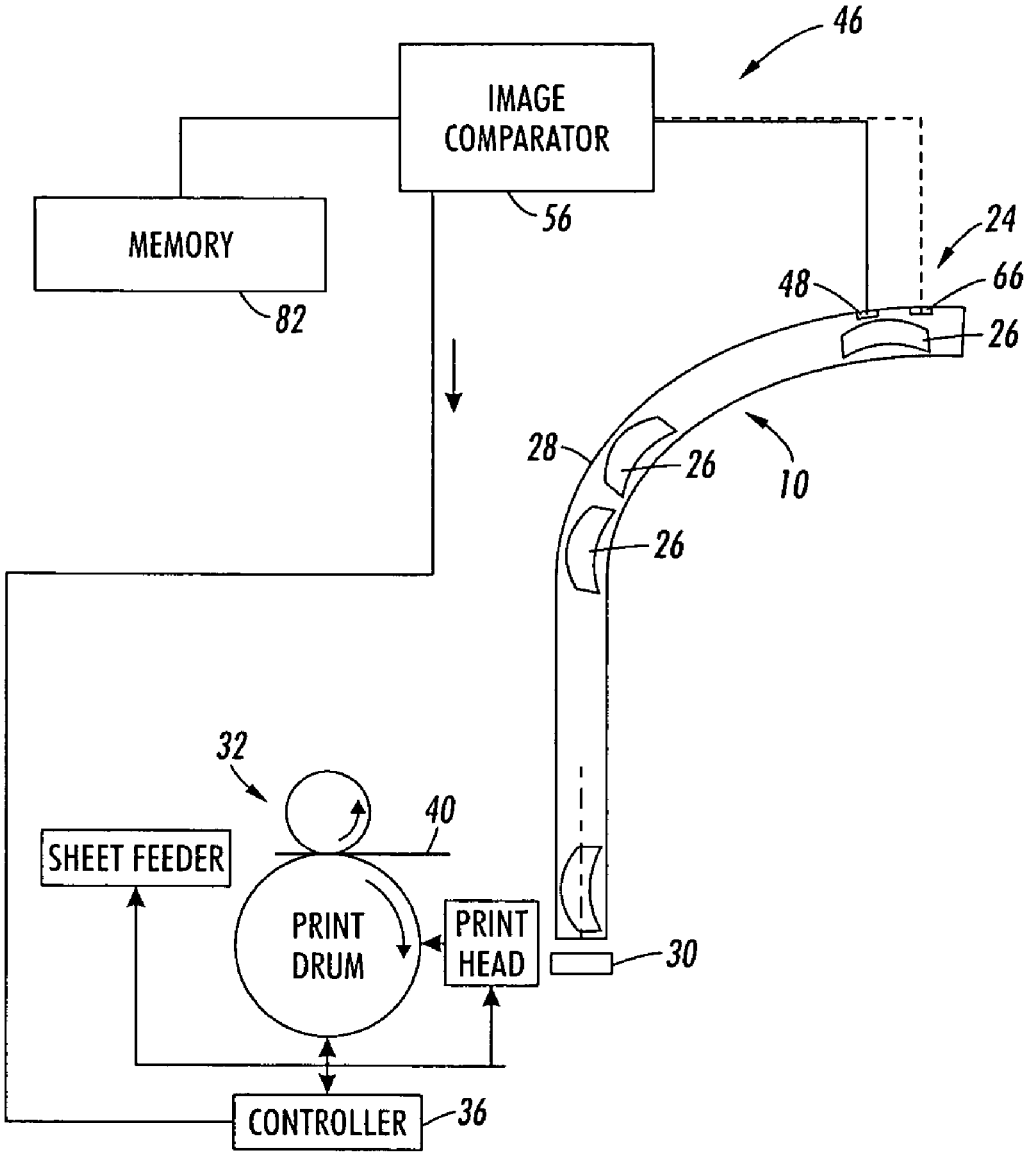
FIG. 2 is a schematic view of a solid ink printer incorporating the ink loader of in FIG. 1 with an image generating device for identifying a solid ink stick inserted into the channel.

Regardless of the type of comparison performed by the image comparator 56, the comparator generates a signal indicative of the comparison result. For example, the image comparator may generate a signal indicating the color of the ink supply is not appropriate for the installation site or feed channel in which the ink supply has been located. A controller 36, which may be coupled to the image comparator 56 to receive the signal generated by the image comparator, responds to the signal with an appropriate control action. For example, the controller 36 may be configured to disable operation of the loader 10 until an operator responds to signal by either overriding the loader disablement or by removing the ink supply installed in the printer. Other control actions are, of course, possible and include, besides control actions that enable, disable, or modify operation of printer components, communication messages to local or remote sites for operator action or logging. A block diagram of a system that couples the ink supply imaging system 46 to a printer 32 through the controller 36 is shown in FIG. 2.

While the camera 48 or 66 may be positioned in the loader 10 where the ambient light is sufficient to obtain an image of an ink supply, a light source (not shown) may be located in the loader to illuminate an ink supply for imaging. The light source may be, for example, a fluorescent bulb, an incandescent bulb, or one or more light emitting diodes (LED) that is positioned within the ink loader 10 to provide light for an image of the ink supply. Alternatively, the camera(s) 48 and/or 66 may include an internal flashing device for illumination of an ink supply. The camera(s) 48 and/or 66 may be capable of generating color images. The image comparator 56 may compare the color in an ink supply color image obtained from the camera with color data stored within the memory 82. This comparison of color image data is expected to provide more accurate color comparisons than those made by a human operator.

The system 46 described above may be configured to store one or more images for each ink supply installed in a printer. These stored images may be downloaded into a device that an operator or service person may connect to the printer. The images then may be downloaded to the portable device so the portable device may be transported to another location so the images may be retrieved from the device. The images of the ink supplies installed in a printer may be, alternatively, transmitted from the printer over a communication network to a central site for storage. These image archives enable the ink supply images to be preserved for later analysis. Regardless of the collection method used, the images may be archived in a repository for later analysis. Such analysis may include determining whether any non-conforming ink supplies have been installed in a printer.

Although the description presented above has been made with reference to a solid ink printer, the system 46 may be used with an aqueous ink printer also. In such a printer, the camera is directed toward an installation site for an aqueous ink cartridge. The image comparator 56 then compares the images of the cartridges installed in the printer to one or more images of ink cartridges stored in the memory 82. As an additional alternative, the system 46 may be used in a printer that uses dry toner to develop images. The imaging device 48 is located in such a printer to generate images of toner cartridges installed in the printer. The image comparator 56 then compares images of the toner cartridges to one or more images of toner cartridges stored in the memory 82.

Figure 3:
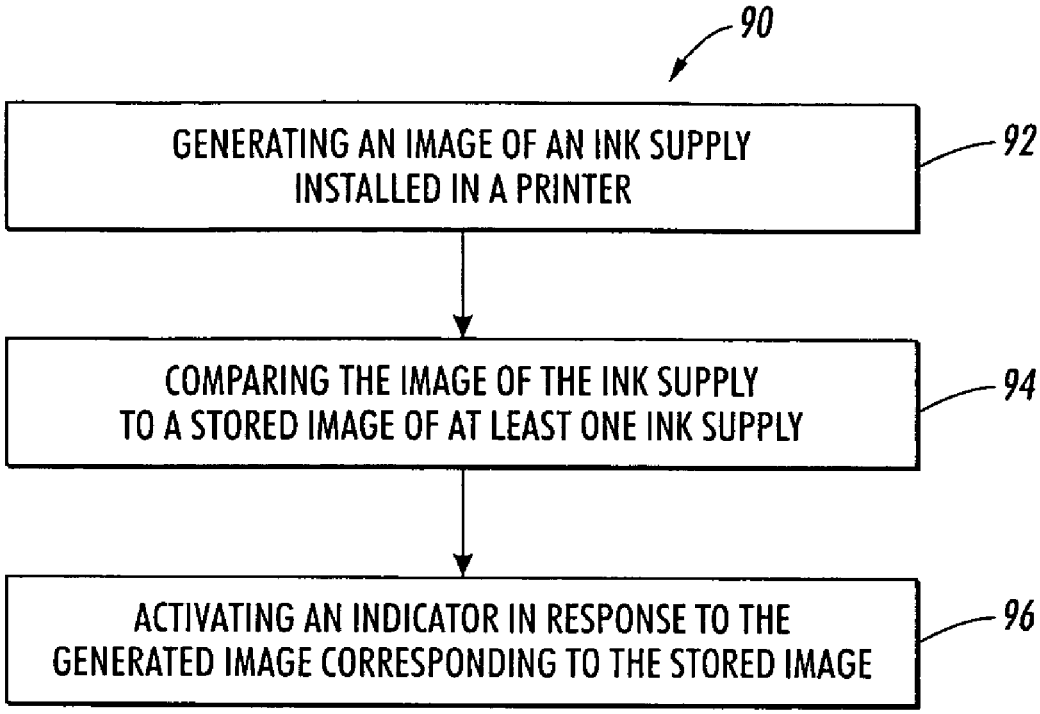
FIG. 3 is a flow diagram of a method of identifying ink.

According to the present disclosure and referring to FIG. 3, a method 90 of identifying an ink supply installed in a printer is shown. The method 90 includes generating an image of an ink supply installed in a printer (block 92) and comparing the image of the ink supply to a stored image of at least one ink supply (block 94). The method 90 further includes activating an indicator in response to the generated image corresponding to the stored image (block 96). The image generation may further include the generation of digital image data with a digital camera located near an ink supply site in the printer. Alternatively, the comparison of the images may include comparing indicia in the generated image of the ink supply to indicia stored in a memory of the printer and the indicator being activated in response to the indicia in the generated image corresponding to indicia stored in the memory of the printer. The indicia may be a machine readable indicia, alphanumeric characters, or a combination thereof.

Variations and modifications of the present invention are possible, given the above description. However, all variations and modifications which are obvious to those skilled in the art to which the present invention pertains are considered to be within the scope of the protection granted by this patent.

What is claimed is:

1. A method for identifying ink supplied to a printer, comprising:

generating with a camera mounted within a printer a first image of an ink supply installed in the printer;

moving the ink supply;

generating with the camera a second image of the ink supply after the ink supply has been moved;

comparing the first image and the second image generated by the camera to a reference image of at least one ink supply stored in a memory in the printer; and activating an indicator in response to the first image and the second image corresponding to the reference image stored in the memory.

2. The method of claim 1 further comprising:

generating from the first image and the second image a three dimensional image of the ink supply for the comparison to the reference image.

3. The method of claim 1 further comprising:

generating a signal in response to a lack of correspondence between the reference image and the first image and the second image; and executing a control action in response to the generated signal.

4. The method of claim 1 further comprising:

storing the first image and the second image of the ink supply in a memory of the printer.

5. The method of claim 1, the comparison of the images further comprises:

comparing a shape of the ink supply in the first image and the second image to a reference ink supply shape stored in a memory of the printer; and the indicator being activated in response to the shape of the ink supply in the first image and the second image corresponding to the reference ink supply shape stored in the memory of the printer.

6. The method of claim 5, the image comparison further comprising:

generating a first image of the ink supply in the printer;

moving the ink supply to another position;

generating a second image of the ink supply in the printer at the other position to obtain another perspective view of the ink supply;

processing the first image and the second image to generate a three dimensional image of the ink supply;

comparing the three dimensional image of the ink supply to the reference image; and activating the indicator in response to the three dimensional image corresponding to the reference image.

7. A system for identifying an ink stick in a solid ink printer comprising:

a video camera located within a solid ink printer that generates multiple images of an ink stick installed in the printer; and an image comparator coupled to the video camera, the image comparator configured to compare the multiple images of the ink stick received from the video camera to a reference image of an ink stick that is stored in a memory in the printer.

8. The system of claim 7, the image comparator being further configured to receive and store reference images of ink sticks in the memory in the printer.

9. The system of claim 7 further comprising:

a controller coupled to the image comparator, the controller being configured to execute a control action in response to the multiple images of the ink stick not corresponding to the reference image of the ink stick stored in the memory.

10. The system of claim 7 further comprising:

a data storage device coupled to the video camera to store the multiple images of the ink stick generated by the video camera.

11. A printer comprising:

a print head for ejecting ink to form an image on an image receiving member as it passes by the print head;

an ink supply site in the printer;

a video camera located proximate the ink supply site to generate multiple images of an ink supply at the ink supply site; and an image comparator coupled to the video camera, the image comparator configured to compare the multiple images of the ink supply to a reference image of an ink supply stored in a memory in the printer and to generate a signal indicating whether the multiple images of the ink supply correspond to the reference image stored in the memory.

12. The printer of claim 11 further comprising:

an ink loader having an insertion port for receiving solid ink, the video camera being located proximate the insertion port to generate multiple images of a solid ink stick placed within the insertion port; and a melting device coupled to the print head and the ink loader, the melting device being configured to melt solid ink sticks transported through the ink loader to the melting device to produce liquid ink that is delivered to the print head for ejection.

* * * * *